US007282862B2

(12) United States Patent
Koerber et al.

(10) Patent No.: US 7,282,862 B2
(45) Date of Patent: Oct. 16, 2007

(54) HIGH-PRESSURE DISCHARGE LAMP WITH MERCURY CHLORIDE HAVING A LIMITED CHLORINE CONTENT

(75) Inventors: Achim Gerhard Rolf Koerber, Kerkrade (NL); Rainer Hilbig, Aachen (DE); Robert Peter Scholl, Roetgen (DE); Johannes Baier, Würselen (DE); Ghaleb Natour, Roetgen (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 191 days.

(21) Appl. No.: 10/535,803

(22) PCT Filed: Nov. 21, 2003

(86) PCT No.: PCT/IB03/05300

§ 371 (c)(1),
(2), (4) Date: May 23, 2005

(87) PCT Pub. No.: WO2004/049386

PCT Pub. Date: Jun. 10, 2004

(65) Prior Publication Data

US 2006/0091812 A1 May 4, 2006

(30) Foreign Application Priority Data

Nov. 26, 2002 (DE) ..... 102 54 969

(51) Int. Cl.
*H01J 61/20* (2006.01)
*H01J 17/20* (2006.01)

(52) U.S. Cl. ..... 313/640; 313/637; 313/639; 313/642

(58) Field of Classification Search ..... 313/637–643
See application file for complete search history.

(56) References Cited

U.S. PATENT DOCUMENTS

| | | | | |
|---|---|---|---|---|
| 3,586,898 | A * | 6/1971 | Speros et al. | 313/635 |
| 4,171,498 | A * | 10/1979 | Fromm et al. | 313/641 |
| 4,319,157 | A | 3/1982 | de Vrijer | |
| 4,801,846 | A * | 1/1989 | Kramer et al. | 313/641 |
| 6,060,829 | A | 5/2000 | Kubon et al. | |
| 6,169,365 | B1 | 1/2001 | Kubon et al. | |
| 6,211,616 | B1 * | 4/2001 | Takeuti et al. | 313/637 |

FOREIGN PATENT DOCUMENTS

| | | |
|---|---|---|
| DE | 3242752 | 9/1983 |
| EP | 0344732 | 6/1989 |

(Continued)

*Primary Examiner*—Joseph Williams
*Assistant Examiner*—Bumsuk Won

(57) ABSTRACT

The invention relates to a high-pressure discharge lamp with a discharge vessel having a filling comprising—a rare gas, for example argon, —mercury, and —chlorine, wherein the filling quantities of mercury [Hg] and chlorine [Cl] comply with the following conditions: —[Hg](E[Cl]$^3$ 200 (μmole/cm3)2, —[Cl] £ 10 μmole/cm3. The condition [Hg](E[Cl]$^3$ 200 (μmole/cm3)2 achieves HgCl vapor pressures in the discharge sufficient for generating significant radiation components of the B2S+-X2S+ band system of this molecule. The condition [Cl] £ 10 μmole/cm3 serves to limit the chemical aggressiveness of the chlorine filling, in particular to limit the attacks on the wall and electrodes and thus to achieve longer lamp lives. The addition of chlorine-binding metals, in particular of germanium, leads to a further improvement in the radiation and life properties of the lamp.

14 Claims, 6 Drawing Sheets

FOREIGN PATENT DOCUMENTS

Figure 1:
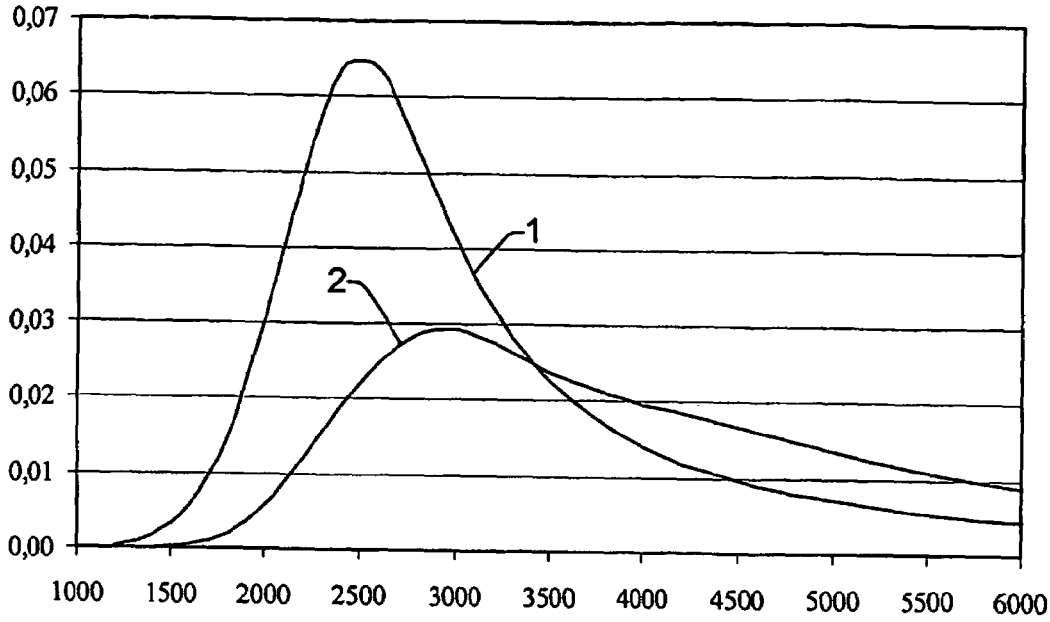

| | | |
|---|---|---|
| EP | 0909457 | 8/1998 |
| EP | 0917180 | 5/1999 |
| GB | 1039649 | 8/1966 |
| GB | 1253948 | 11/1971 |
| GB | 1283152 | 7/1972 |
| WO | WO98/37570 | 8/1998 |

* cited by examiner

HIGH-PRESSURE DISCHARGE LAMP WITH MERCURY CHLORIDE HAVING A LIMITED CHLORINE CONTENT

The invention relates to a high-pressure discharge lamp with a discharge vessel having a filling comprising a rare gas, for example argon, mercury, and chlorine.

Mercury high-pressure lamps are used in a large number of lighting applications such as, for example, street lighting on account of their high luminous efficacy. Although the mercury atom is a line radiator with a bad color rendering, it is possible to increase the continuum component of the emitted radiation significantly through an increase in the mercury pressure in lamps of very high pressure or the addition of molecular radiators such as, for example, metal halides. Such lamps then have good color rendering properties in combination with a high luminous efficacy and are also suitable, for example, for applications such as the illumination of shop displays or studio lighting installations.

GB 12 53 948 B discloses, for example, a mercury high-pressure lamp with electrodes, whose filling of mercury and a rare gas for starting is supplemented with aluminum trichloride $AlCl_3$ for improving the color rendering. This lamp has a high continuum component in its emitted radiation and has a good color rendering. The chemical aggressiveness of the $AlCl_3$, however, renders it impossible to use pure quartz glass $SiO_2$ for the lamp bulbs, and the tungsten electrodes are also attacked. GB 12 53 948 B accordingly proposes to manufacture the lamp bulb from densely sintered polycrystalline aluminum oxide $Al_2O_3$, also known as DGA or PCA, or to coat a quartz glass bulb at least with an inner protective layer of PCA. It proposes in addition to limit the tungsten transport, and thus the attack on the tungsten electrodes, through the addition of excess metal, in particular aluminum in excess quantity, while preferably in addition some metal iodide, in particular $AlI_3$, may be added.

To explain the effect of these filling additives, GB 12 53 948 B presents a few possible chemical equilibrium reactions, clarifies the significance of oxygen pollution inside the lamp, and supplies some relevant material data. Furthermore, a few embodiments of relevant lamps are disclosed. As far as these aspects are concerned, the contents of the cited publication are deemed to be included in the present application by reference.

GB 12 53 948 B does provide a lamp of high luminous efficacy and good color rendering, but the problems of attacks on the bulb wall and the electrodes remain, necessitating the use of a chlorine-resistant inner wall and limiting lamp life owing to the tungsten transports that still take place.

It is accordingly an object of the present invention to provide a high-pressure discharge lamp which avoids these problems to a high degree in combination with a high luminous efficacy and good color rendering, thus achieving a long lamp life.

This object is achieved by means of a high-pressure discharge lamp with a discharge vessel having a filling comprising a rare gas, for example argon, mercury, and chlorine, wherein the filling quantities of mercury [Hg] and chlorine [Cl] comply with the following conditions:

$$[Hg].[Cl] \geqq 200\ (\mu mole/cm^3)^2,$$

$$[Cl] \leqq 10\ \mu mole/cm^3.$$

The invention is based on the one hand on the recognition that the condition $[Hg].[Cl] \geqq 200\ (\mu mole/cm^3)^2$ leads to sufficient HgCl vapor pressures in the discharge for generating significant radiation components of the $B^2\Sigma^+$-$X^2\Sigma^+$ band system of this molecule. A high continuum component of the generated radiation, and accordingly the desired good color rendering, is achieved thereby in combination with a high luminous efficacy. On the other hand, the condition $[Cl] \leqq 10\ \mu mole/cm^3$ serves to limit the chemical aggressiveness of the chlorine filling, in particular for limiting the attacks on the wall and electrodes, and thus to achieve long lamp lives. Although high-pressure lamps with fillings comprising inter alia mercury and chlorine are indeed known from the prior art, for example from GB 12 53 948 B, the recognition of the invention is that a prominent component of the HgCl radiation is to be provided while at the same time the aggressiveness of the chlorine filling is to be limited.

The filling quantities indicated in the present application should always be understood to be the total filling quantities relating to the atoms. Molecules should accordingly be stoichiometrically converted; 1 mole $Hg_2$, for example, thus represents a filling quantity of [Hg]=2 mole, and 1 mole $Hg_2$ and 1 mole HgCl correspond to the quantities of [Hg]=3 mole and [Cl]=1 mole.

It will be clear to those skilled in the art, moreover, that such filling quantity relations serve to adjust the vapor pressure ratios in the lamp, i.e. the gas phase composition, and the material transports within the desired limits. Thus the condition $[Hg].[Cl] \geqq 200\ (\mu mole/cm^3)^2$, for example, has the result that a mercury chloride vapor pressure of approximately $P_{HgCl} \leqq 2$ mbar is present in the radiant region of the discharge at 4000 K in a thermodynamic equilibrium condition.

This gas phase composition will obviously only adjust itself if no further substances are present in the filling which could shift the composition properties. Thus, for example, there is a series of metals, such as, for example, barium, magnesium, sodium, and silver, which also form comparatively stable chlorides, i.e. for example $BaCl_2$, $MgCl_2$, NaCl, and HgCl, at elevated temperatures. For $BaCl_2$ at 1200 K, for example, the vapor pressures are only $p_{Ba}$=0.0016 mbar and $p_{Cl}+p_{Cl2}$=0.0032 mbar, so that the contribution of this compound to the typical chlorine summed vapor pressures of, for example, 0.35 bar in the lamps according to the invention would be practically negligible, i.e. these substances operate as it were as chlorine getters. Although the presence of certain quantities of such substances in the filling, for example as impurities, are accordingly quite acceptable, because the compounds formed are deposited in non-critical locations of the lamp, for example as solid substances, they do obviously influence the required filling quantities of the active substances, i.e. for example of Hg and Cl.

The quantitative data mentioned in the present application for the filling quantities accordingly relate to the case of comparatively clean lamps that can typically only be prepared under laboratory conditions and that essentially contain only the active substances mentioned above, i.e. except for impurities that are difficult to avoid such as, for example, certain traces of oxygen. The quantitative data should accordingly be adapted under manufacturing conditions and/or when further filling ingredients are purposely added. Those skilled in the art may have recourse to the knowledge present in the prior art on the thermodynamic equilibrium in lamp chemistry for the purpose of such an adaptation. On the other hand, direct comparisons obtained from measurements, for example of the emitted light spectrum and the lamp life properties, may be made, for example with clean lamps manufactured in the laboratory so as to ascertain the operation according to the invention of a manufactured lamp.

The further addition of a metal, preferably one that forms more stable chloride compounds than mercury, and in particular one from the group of aluminum, arsenic, bismuth, cobalt, gallium, germanium, indium, lead, tin, thallium, and vanadium, and in particular the addition of germanium, renders it possible to improve the properties of a lamp according to the invention still further. These metals may be added both in pure form and in the form of mixed alloys or in the form of suitable compounds which release the metals during lamp operation without otherwise interfering with lamp operation. Such a metal then acts as a chlorine binder, i.e. it binds chlorine in colder regions of the lamp during lamp operation, which provides several positive effects.

On the one hand, the chemical aggressiveness of the chlorine, i.e. the attacks on the wall and the electrodes, are further reduced thereby. On the other hand, the HgCl content in the gas phase is reduced thereby in the colder lamp regions, because the metals compete with the mercury as a chlorine binder. A lower HgCl concentration in the outer, cooler lamp regions, however, reduces the self-absorption of the HgCl radiation generated in the hot lamp regions, i.e. increases the total of HgCl radiation emitted by the lamp. Furthermore, it should be heeded with the use of tungsten electrodes that $WCl_2$ may precipitate in solid form in the coldest spot of the lamp, i.e. that tungsten acts as it were as a chlorine getter in the course of lamp life, so that gradually less and less chlorine is available for forming HgCl, i.e. is removed from the radiation-generating process. Since the addition of the above metals reduces the tungsten transport to the wall and thus also to the coldest spot, as was noted above, and since the metals compete with the tungsten for binding chlorine, but the metal chlorides are gaseous, the formation of the solid $WCl_2$ is reduced thereby, so that the chlorine is at least less strongly removed from the processes that are important for radiation generation.

The favorable effects of the chlorine-binding metals mentioned above manifest themselves particularly if the filling contains these metals in a stoichiometrical excess quantity in relation to chlorine, so that the chlorine can be bound in a sufficient quantity. To obtain a stoichiometrical excess quantity, the sum [M] of the filling quantities of the chlorine-binding metals must comply with: $[M]/[Cl] \geqq 1/W_M$, where $W_M$ denotes the average valency of the chlorine-binding metals. The sum [M] of the filling quantities of the chlorine-binding metals is to be understood to be the summed filling quantities of all these metals relating to the atoms, as was explained above. For example, 1 mole Al+2 mole $GeCl_2$ corresponds to a summed filling quantity of [M]=3 mole chlorine-binding metals. The average valency $W_M$ of the chlorine-binding metals may be calculated as the arithmetic mean of the valencies of the individual metals in the mixture, weighted by their mixing ratios. In the above example of 1 mole Al+2 mole $GeCl_2$, the trivalent Al in $AlCl_3$ and the bivalent Ge in $GeCl_2$ in combination with the ratio Al:Ge=1:2 lead to an average valency of $W_M=(1\cdot 3+2\cdot 2)/3=7/3$. For the sake of simplicity, only the bivalent variant of Ge in $GeCl_2$ that is predominant in lamp operation has been taken into account in this equation. The other valencies of Ge in the further germanium chloride variants GeCl, $GeCl_3$, and $GeCl_4$ as well as the mixing ratios of these variants in the thermodynamic equilibrium in the temperature ranges relevant for the lamp should also be taken into account for a more exact calculation, in which case in particular the monovalent Ge in GeCl is of importance as the next most frequent variant after $GeCl_2$ in the lamp.

Operating pressures above 400 bar are difficult to control technologically as regards the resistance to pressure of the lamp bulb and possibly of the electrode lead-throughs under operating conditions of, for example, a temperature of the coldest spot of 1250 K, for example because of the risk of explosion of the lamp vessel. The filling quantity [Hg] of mercury should preferably be limited to $[Hg] \leqq 2000$ μmole/$cm^3$. Since the product of the Hg and Cl filling quantities should be at least 200 $(\mu mole/cm^3)^2$ because of the required HgCl vapor pressure, as explained above, the maximum quantity of $[Hg] \leqq 2000$ μmole/$cm^3$ leads to a corresponding condition for the minimum filling quantity of Cl of $[Cl] \geqq 0.1$ μmole/$cm^3$. The maximum quantity of Cl, $[Cl] \leqq 10$ μmole/$cm^3$, required because of the limitation of the Cl aggressiveness, and the condition for the product of the Hg and Cl filling quantities also lead to a condition for the minimum quantity of Hg, i.e. $[Hg] \geqq 20$ μmole/$cm^3$.

The discharge vessel may also be manufactured from quartz glass because of the limitation of the aggressiveness of the chlorine filling according to the invention. Obviously, however, oxidic ceramic substances, and in particular the densely sintered polycrystalline aluminum oxide (DGA or PCA) may also be used. Similarly, the limited aggressiveness means that metal electrodes, in particular tungsten electrodes may be used for coupling the energy into the lamp vessel. In a further embodiment, the electrodes may be manufactured from several metals, in particular from tungsten and rhenium. Furthermore, coated electrodes may also be used, in particular those formed by a tungsten core and a coating that consists of rhenium for at least 90% by weight. Reference is made to EP 0 909 457 A1, U.S. Pat. No. 6,169,365 B1, and U.S. Pat. No. 6,060,829 A in respect of such composite or coated electrodes, which documents are deemed to be included in the present application by reference as far as these subjects are concerned. Alternatively, the energy may be coupled into the lamp without electrodes, for example by means of an electromagnetic alternating field in the high-frequency or microwave range, in particular in a range of 0.5 to 500 MHz or 500 MHz to 50 GHz. Although the problems caused by the presence of electrodes are avoided thereby and a wider freedom of design is obtained for the lamp, other problems arise such as, for example, a higher cost and limited efficiencies of the generator for the electromagnetic alternating field.

The invention, however, also relates to a lighting unit which is provided with a high-pressure discharge lamp according to the invention. This lighting unit may comprise in particular also the electrical driver circuit for providing the lamp with energy in the case of an electrodeless energy supply by means of an electromagnetic alternating field, i.e. for example also a generator for generating this alternating field.

Figure 2:
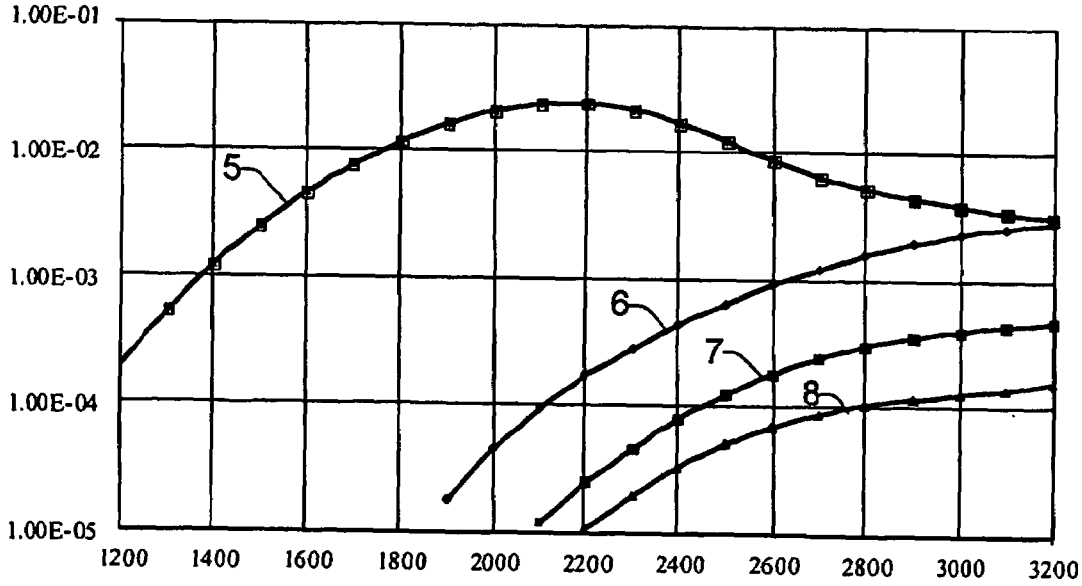
Figure 9:
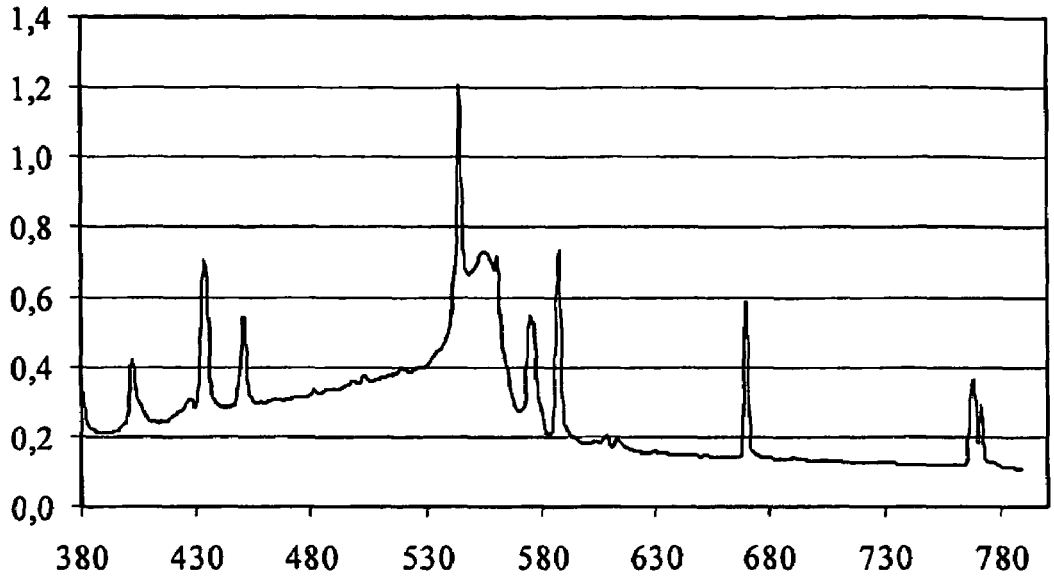
Figure 10:
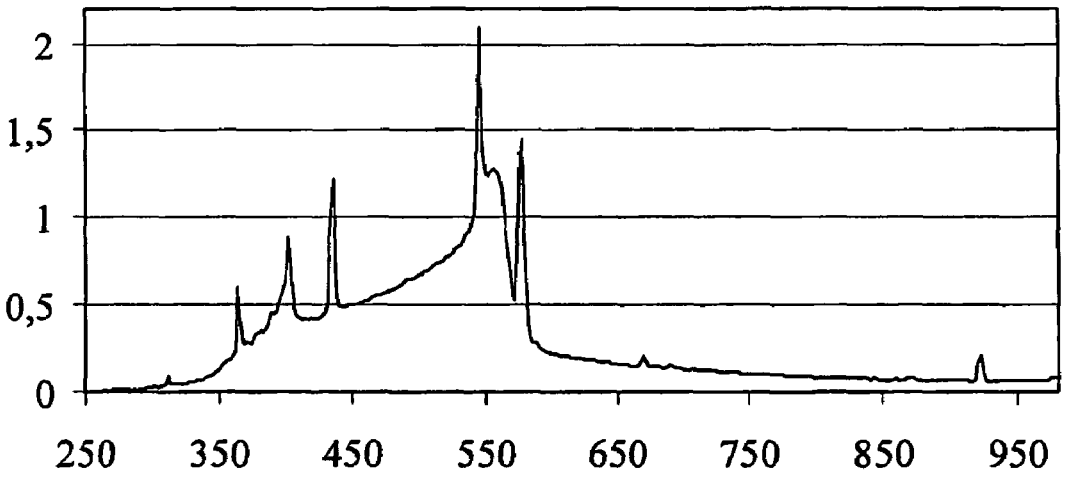
Figure 11:
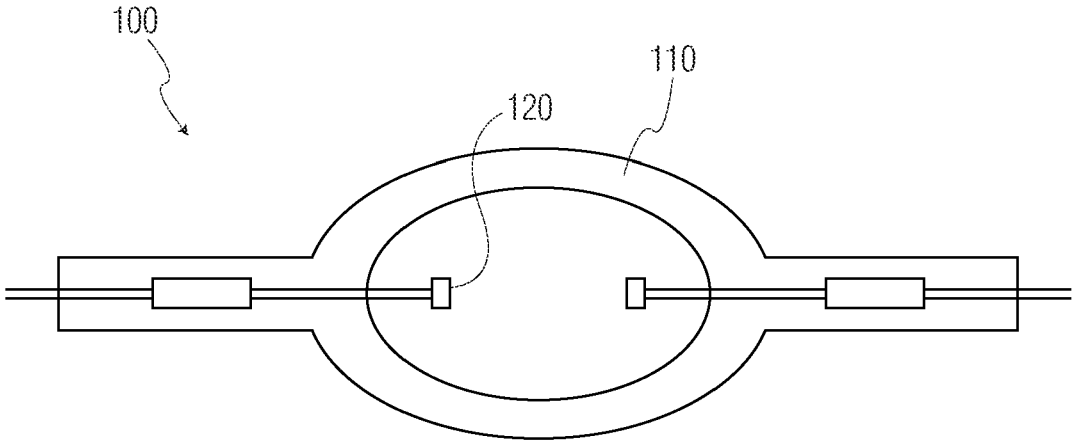

These and further aspects and advantages of the invention will be explained in more detail below with reference to the embodiments and in particular with reference to the accompanying drawings, in which:

FIG. 1 plots the partial pressures of HgCl resulting from a thermodynamic equilibrium calculation as a function of temperature, FIG. 2 plots the summed partial pressures of tungsten resulting from a thermodynamic equilibrium calculation as a function of temperature, FIGS. 3 to 10 are spectrums of embodiments of high-pressure lamps according to the invention, and FIG. 11 shows a discharge lamp according to one embodiment.

FIG. 1 shows the HgCl partial pressures in the gas phase resulting from a thermodynamic equilibrium calculation as a function of temperature. The vertical axis of the diagram shows the HgCl partial pressure in bar and the horizontal axis the temperature in K. The gradient of the upper curve 1 in the diagram is the HgCl partial pressure resulting from a thermodynamic equilibrium calculation when 140 μmole/$cm^3$ Hg and 10 μmole/$cm^3$ Cl are filled into the vessel. The lower curve 2 is valid for a similar situation when in addition to the 140 μmole/$cm^3$ Hg and 10 μmole/$cm^3$ Cl an additional 7.5 μmole/$cm^3$ Ge was introduced at room temperature. It is apparent from a comparison of these two curves that the addition of Ge clearly increases the HgCl partial pressure in the hot, radiating region of the discharge, i.e. approximately above 3500 K, because the prevention of condensation of solid $WCl_2$ avoids the removal of Cl from the discharge, and clearly reduces it at the lower temperatures of the outer regions of the gas filling close to the wall, i.e. approximately between 1200 and 3000 K. The addition of Ge is accordingly advantageous in two respects: first, it increases the HgCl concentration in the radiant center of the discharge, which leads to the generation of a stronger HgCl continuum radiation, and second, it provides a reduction in the HgCl concentration in the non-radiant outer regions of the lamp filling, so that the self-absorption of the HgCl radiation generated in the radiant regions is reduced in these layers.

Besides the germanium, there is a series of further substances which form chlorides in the colder lamp regions which are more stable than the HgCl, which has a dissociation energy of 101 Kj/mole. Relevant metal chlorides have been listed in the following Table together with their dissociation energy values:

TABLE 1

| Metal chloride | Dissociation energy [kJ/mole] |
|---|---|
| AlCl | 499 |
| GaCl | 463 |
| InCl | 434 |
| GeCl | 429 |
| VCl | 424 |
| SnCl | 388 |
| TlCl | 369 |
| CoCl | 357 |
| AsCl | 351 |
| PbCl | 308 |
| BiCl | 305 |

FIG. 2 shows the summed partial pressures SpW of tungsten resulting from a thermodynamic equilibrium calculation as a function of temperature. The vertical axis of the diagram shows the sum of the partial pressures of all tungsten compounds in the gas phase in bar, and the horizontal axis shows the temperature in K. The partial pressure of a tungsten compound in the sum again relates to the atomic tungsten quantity, i.e. the tungsten content is entered stoichiometrically. The compound $W_2Cl_{10}$, for example, would thus be entered with a factor of 2 for $W_2$ in the tungsten summed pressure. The curves 5 to 8 each result from a thermodynamic equilibrium calculation in which the tungsten is present as an unlimited solid body reservoir, and the following further substances have been introduced in the following quantities indicated in μmole/$cm^3$ (sample-and-hold calculation mode):

TABLE 2

| Curve | Fill quantities[μmole/$cm^3$] |
|---|---|
| 5 | 140 Hg, 10 Cl |
| 6 | 140 Hg, 10 Cl, 7.5 Ge |
| 7 | 375 Hg, 3.5 Cl, 5 Ge |
| 8 | 375 Hg, 1.8 Cl, 2.5 Ge |

Such curves are generally used for making certain predictions on the tungsten transport occurring in the lamp. It is assumed therein that the tungsten is transported from regions of high tungsten summed pressure to regions of low tungsten summed pressure. In curve 5, for example, tungsten would be transported from regions around 2200 K to regions of lower and higher temperature. It is furthermore assumed that tungsten summed pressures above a few mbar typically lead to too high tungsten transport rates, which limit lamp life to a few seconds, which is unacceptable for many applications. Thus, for example, the tungsten of curve 5 would be transported from the electrode region, which has a temperature of approximately 2200 K, to the colder (and also to the hotter) spots on the electrode and the lamp wall. This location present in the central region of the electrode would accordingly become progressively thinner, and the electrode would finally be severed in this location owing to this so-termed "beaver gnawing" effect.

A comparison of curves 6 and 5 leads to the recognition that the addition of Ge is already a very effective means for substantially reducing the tungsten summed pressure, in this example to below approximately 3 mbar, which leads already to lamp lives which are acceptable for a few applications. The tungsten summed pressure, however, can be further reduced by means of a reduction in the chlorine filling quantity, in which case the Hg filling quantity is to be correspondingly increased because of the condition for the product of the Hg and Cl filling quantities of $[Hg].[Cl] \geqq 200$ $(\mu mole/cm^3)^2$. Thus curve 7 shows tungsten summed pressures below 0.4 mbar, and curve 8 below approximately 0.2 mbar, which lead to correspondingly longer lamp lives.

The smaller chlorine filling quantities in curves 7 and 8 render it possible also to reduce the germanium addition to these fillings.

The getter effect of the tungsten with respect to chlorine in the colder lamp regions should be pointed out again here. The reduction in the tungsten transport rates caused by the reduction in the chlorine filling quantity and/or the addition of metals such as germanium distinctly slows down the accumulation of tungsten in the colder lamp regions. This then slows down the formation of $WCl_2$ and its precipitation in the solid state in a corresponding manner, and thus the negative effect of the chlorine removal on the radiation generation. This improves the radiant maintenance of the lamp considerably during lamp life, i.e. the decrease in the generated radiant power over lamp life is considerably reduced.

FIGS. 3 to 10 show spectrums of embodiments of high-pressure lamps according to the invention. The wavelengths of the emitted radiation are plotted in nm on the horizontal axes of these Figures, and the radiant intensity in W/nm on the vertical axes.

The data of the embodiments to which FIGS. 3 to 6 relate have been collected in the following Table:

TABLE 3

Figure 3:
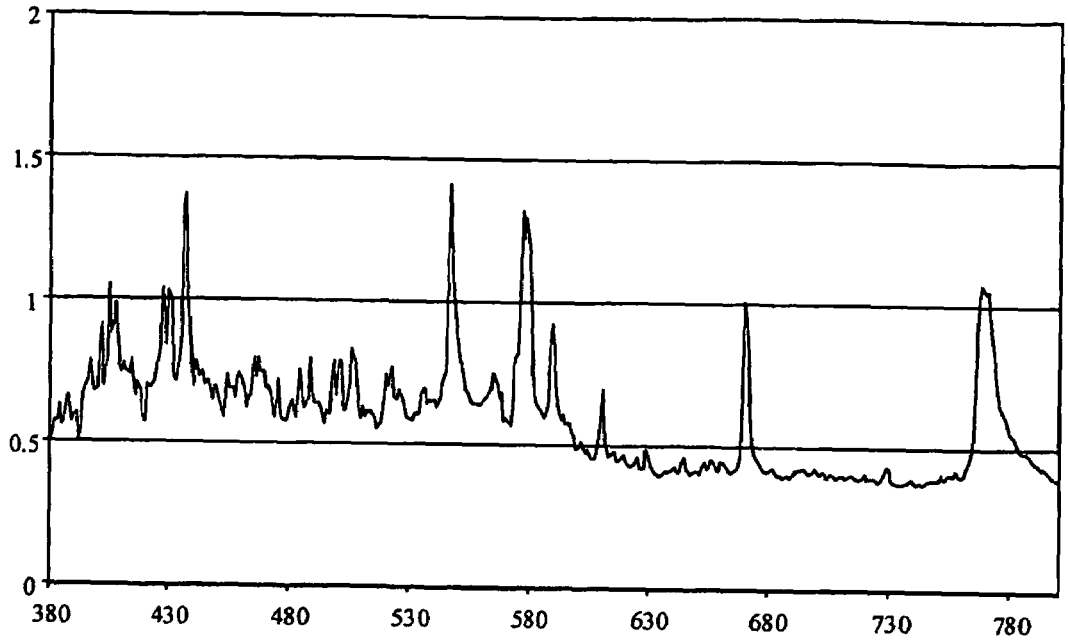
Figure 4:
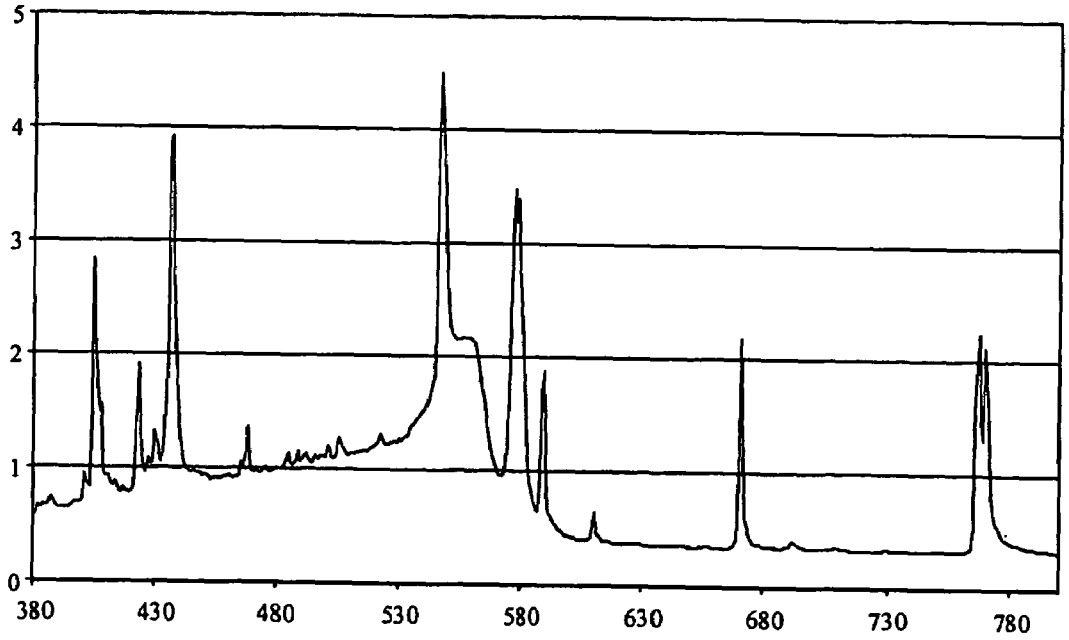
Figure 5:
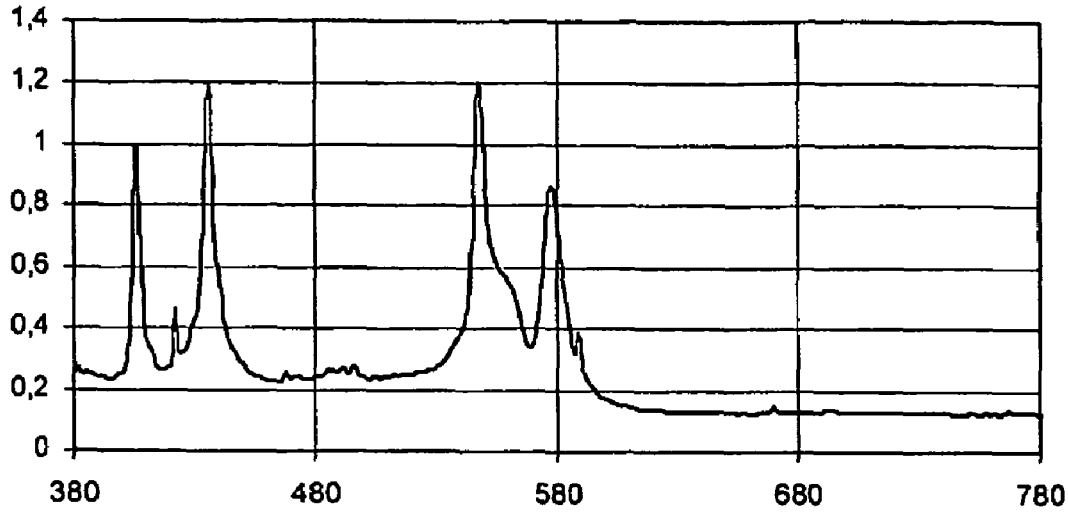
Figure 6:
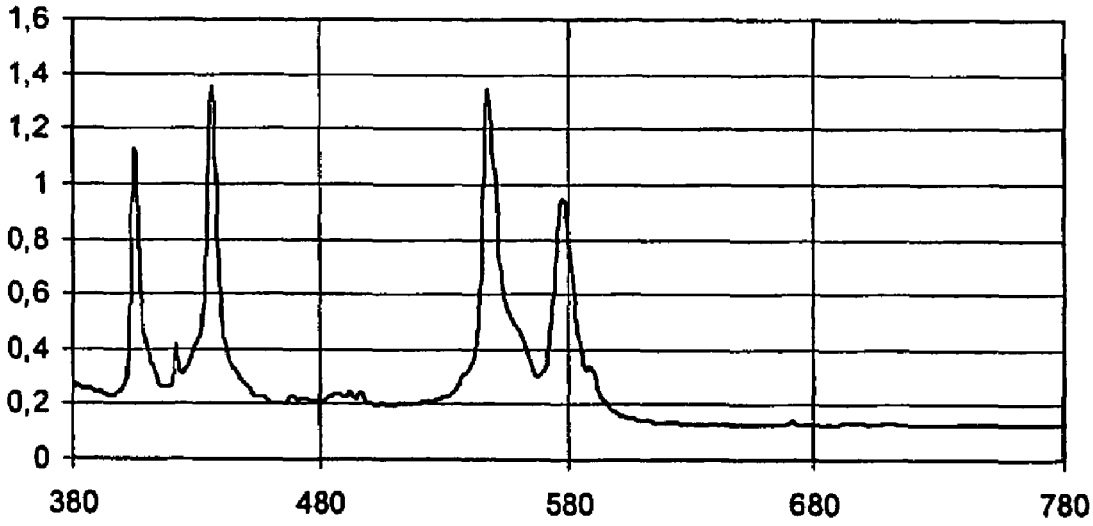

| Data | | Embodiment of FIG. 3 | Embodiment of FIG. 4 | Embodiment of FIG. 5 | Embodiment of FIG. 6 |
|---|---|---|---|---|---|
| Lamp vessel Dimensions | | Spherical, quartz Inner diameter: 17 mm | | Elliptical, quartz Inner diameter: 11 mm, Inner length: 16 mm | |
| Energy transfer | | Tungsten electrodes | | | |
| Electrode spacing[mm] | | 7.0 | | 2.0 | |
| Filling [μmole/cm³] | Ar | 4.2 | | | |
| | Hg | 134 | | 375 | |
| | Cl | 9.7 | | 3.5 | 1.8 |
| | Ge | 0 | 7.5 | 5 | 2.5 |
| Power [W] | | 800 | 800 | 400 | 400 |
| Efficacy [lm/W] | | 61 | 124 | 84 | 80 |
| Life | | ~1 h | a few10 h | >100 h | ? (>~5 h) |

Except for FIG. 3, the spectrums of these embodiments clearly show the B-x molecular emission of the HgCl, while no GeCl emission and only weak Ge lines at 422.7 nm and 468.6 nm occur. It is clear for the lamp of FIG. 3, whose Cl concentration of 9.7 μmole/cm$^3$ is close to the upper limit of the region according to the invention of up to 10 μmol/cm$^3$, that the HgCl emission is hardly observable without the addition of a chlorine-binding substance, whereas this emission becomes clearly visible after the addition of 7.5 μmole/cm$^3$ of Ge, cf. FIG. 4. This is accompanied by a distinct increase in luminous efficacy of the lamp from 61 to 124 lm/W.

The fillings of the lamps with the spectrums of FIGS. 3 to 6 correspond substantially to the tungsten summed pressures of the curves 5 to 8 calculated in FIG. 2. The advantages of the addition of germanium as a chlorine binder and the reduction in the chlorine content, possibly accompanied by an increase in the Hg filling quantity, can be clearly seen. Highly efficient lamps with good color rendering and a long life can thus be obtained through fine tuning of the filling quantities. Thus, for example, a comparison of the embodiment of FIG. 5 with that of FIG. 4 shows a clearly improved lamp life while the luminous efficacy is still very good. Similarly, a further prolongation of lamp life is expected in the lamp of FIG. 6, whose filling corresponds to curve 8 of FIG. 2, because of the clearly reduced chlorine content, while it has a similar luminous efficacy and color rendering to those of the lamp of FIG. 5 because of the similarity of the spectrum. No life tests were carried out until now, however, only short-time experiments of a few hours.

Instead of or in addition to germanium as the chlorine binder, alternative metals of a similar chemical action may be used as chlorine binders. The metals mentioned above are preferably used here, which form more stable chloride compounds than mercury, in particular besides germanium, also aluminum, arsenic, bismuth, cobalt, gallium, indium, lead, tin, thallium, and vanadium. The following Table relating to the embodiments of FIGS. 7 to 9 contains first results of the use of Ga, Al, and Sn as chlorine binders. Very large chlorine quantities clearly above the upper limit according to the invention of [Cl]≦10 μmole/cm$^3$ were used in these experiments so as to achieve sufficient HgCl vapor pressures in the discharge at the start of lamp life in all cases. The technically fully insufficient lamp lives of approximately one hour, however, clearly show that such large chlorine quantities cannot be used in products.

Figure 7:
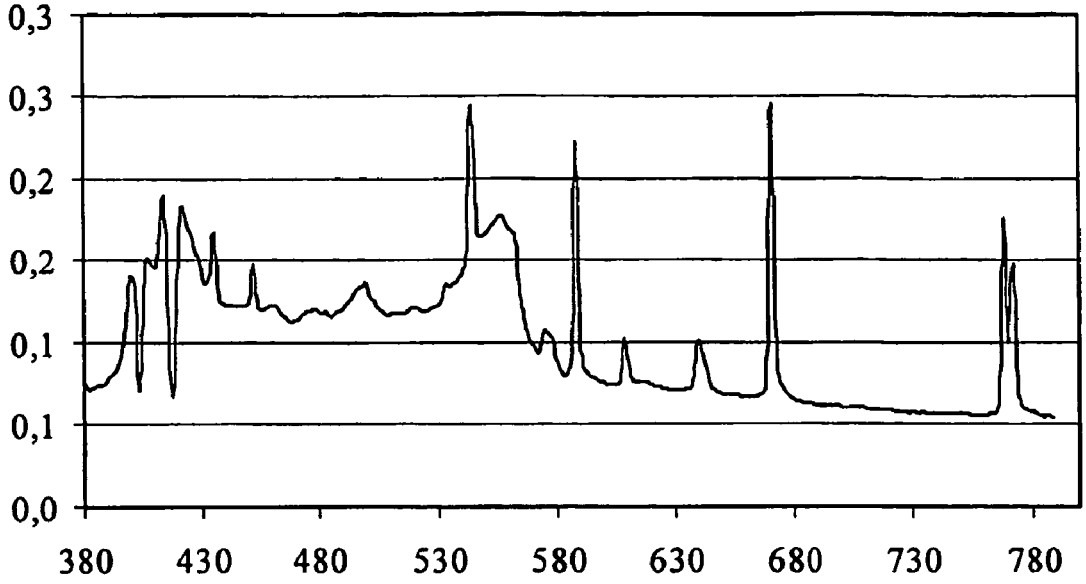
Figure 8:
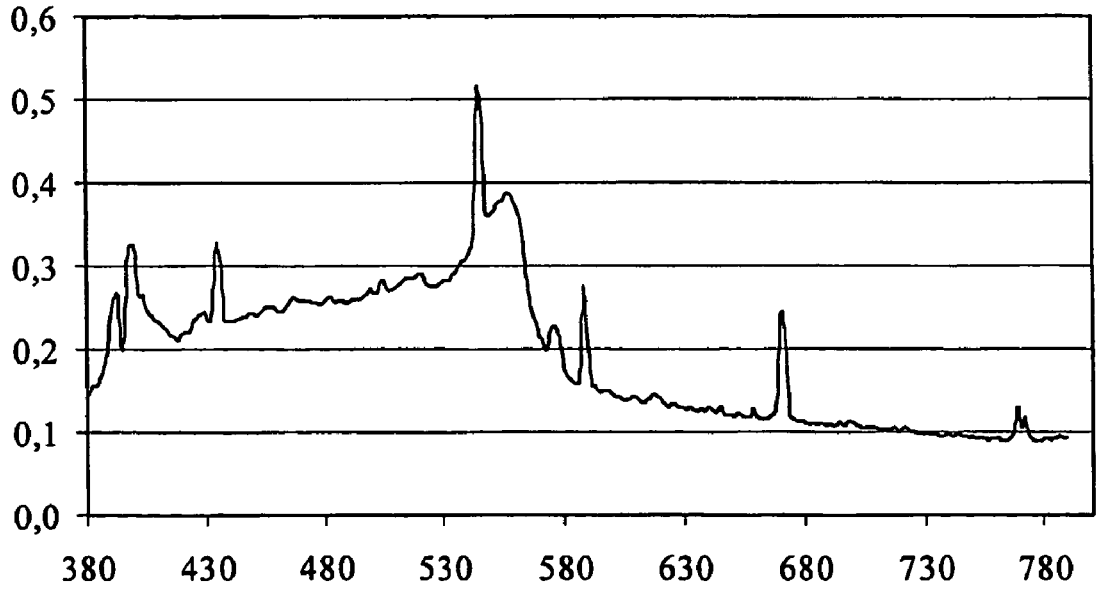

Although no such lamp with such a filling and a long lamp life has indeed been experimentally demonstrated until now, the comparisons of the embodiments of FIGS. 7 to 9 nevertheless show the positive influence of the reduction of the chlorine quantity and the increased addition of the chlorine binder. The development of such a lamp having a long lamp life is accordingly merely a question of further systematic experiments, and thus lies within the scope of action of the average skilled person.

TABLE 4

| Data | | Embodiment of FIG. 7 | Embodiment of FIG. 8 | Embodiment of FIG. 9 |
|---|---|---|---|---|
| Lamp vessel Dimensions | | Elliptical, quartz Inner diameter: 10.5 mm, Inner length: 13.5 mm | | |
| Energy transfer | | Tungsten electrodes | | |
| Electrode spacing [mm] | | 7.5 | | |
| Filling [μmole/cm³] | Ar | 0.51 | | |
| | Hg | 72 | | |
| | Cl | 23 | 87 | 11 |
| | Chlorine binder | Ga: 11.6 Sn: 4.1 | Al: 29 | Sn: 10 |
| Power [W] | | 255 | 250 | 290 |
| Efficacy [lm/W] | | 34 | 73 | 102 |
| Life [h] | | | ~1 | |

FIG. 10 shows the spectrum of an electrodeless embodiment whose data are summarized in the following Table. Since the problems of electrode attacks are absent here, this first experiment was also carried out with an increased chlorine quantity above the upper limit of [Cl]≦10 μmole/cm$^3$ according to the invention. The addition of a chlorine binder was also dispensed with. The addition of sulphur to the lamp filling was made to investigate its effect on the lamp spectrum. This effect, however, is judged to be small.

TABLE 5

| Data | | Embodiment for FIG. 10 |
|---|---|---|
| Lamp vessel Dimensions | | Spherical, quartz Inner diameter: 21 mm |
| Energy transfer | | Microwave resonator, 2.45 GHz |
| Filling [μmole/cm³] | Ar | 4.0 |
| | Hg | 76 |
| | Cl | 14 |
| | Filling additive | S: 17 |
| Power [W] | | 400 |
| Efficacy [lm/W] | | 150 |
| Life [h] | | ? (>~5 h) |

This electrodeless lamp shows a high luminous efficacy of 150 lm/W. An evaluation of the system efficacy, however, should take into account the low efficiency of the microwave generation in comparison with ballast circuits for lamps provided with electrodes. The high price of the microwave resonator also has a negative effect on the lamp cost. Life tests have not yet been carried out with this lamp, the short-time burning periods were only a few hours. A chlorine attack of the bulb wall is nevertheless expected at high chlorine quantities, although the electrode problems are absent, in the case of correspondingly longer burning times, as was already noted in GB 12 53 948 B. A clear prolongation of lamp life is accordingly also assumed for such lamps as a result of the reduction in chlorine quantity according to the invention.

An illustrative embodiment of a discharge lamp 100 is shown in FIG. 11 having a discharge vessel 110 which may be elliptical in shape and made of quartz. The inner diameter of the discharge vessel 110 is 11 mm and the inner length is 16 mm. Tungsten electrodes 120 are provided for coupling electrical power into the high-pressure discharge lamp 100.

The invention claimed is:

1. A high-pressure discharge lamp with a discharge vessel having a filling comprising: a rare gas, mercury, and chlorine, wherein the discharge vessel is elliptical in shape, is made of quartz, and has an inner diameter of 11 mm and an inner length of 16 mm, the high-pressure discharge lamp further comprising tungsten electrodes for coupling electrical power into the high-pressure discharge lamp, and the filling further comprises 4.2 μmole/$cm^3$ argon, 375 μmole/$cm^3$ mercury, 1.8 μmole/$cm^3$ chlorine, and 2.5 μmole/$cm^3$ germanium.

2. The high-pressure discharge lamp as claimed in claim 1, wherein the filling further comprises a metal that forms more stable chloride compounds than does the mercury, said metal being chosen from the group of aluminum, arsenic, bismuth, cobalt, gallium, germanium, indium, lead, tin, thallium, and vanadium as a chlorine binder.

3. The high-pressure discharge lamp as claimed in claim 2, wherein a sum [M] of the filling quantities of metals that are chlorine-binding complies with the condition: $[M]/[Cl] \geqq 1/W_M$, where $W_M$ denotes average valency of the metals that are chlorine-binding.

4. The high-pressure discharge lamp as claimed in claim 1, wherein the filling comprises germanium as a chlorine-binding metal.

5. The high-pressure discharge lamp as claimed in claim 1, wherein the discharge vessel is made of quartz or an oxidic ceramic material.

6. The high-pressure discharge lamp as claimed in claim 1, further comprising, for coupling electrical power into the high-pressure discharge lamp: tungsten electrodes, or composite tungsten and rhenium electrodes, or coated electrodes formed by a tungsten core and a coating comprising at least 90% by weight of rhenium.

7. A lighting unit comprising the high-pressure discharge lamp as claimed in claim 1.

8. The lighting unit as claimed in claim 7, further comprising, for coupling electrical power into the high-pressure discharge lamp: a generator for generating an electromagnetic alternating field in a range of 0.5 to 500 MHz or 500 MHz to 50 GHz.

9. The high-pressure discharge lamp of claim 1, wherein the discharge vessel is made of densely sintered aluminum oxide.

10. A high-pressure discharge lamp comprising:

a discharge vessel having a ratio of an inner diameter to an inner length of substantially 11/16;

electrodes for coupling electrical power into the high-pressure discharge lamp; and a filling in the discharge vessel, wherein the filling comprises argon, mercury, chlorine and germanium in proportions with each other that substantially comply with 4.2 μmole/$cm^3$ of the argon, 375 μmole/$cm^3$ of the mercury, 1.8 μmole/$cm^3$ of the chlorine, and 2.5 μmole/$cm^3$ of the germanium.

11. The high-pressure discharge lamp of claim 10, wherein a sum [M] of the filling quantities of metals that are chlorine-binding complies with the condition:

$[M]/[Cl] \geqq 1/W_M$, where $W_M$ denotes average valency of the metals that are chlorine-binding.

12. The high-pressure discharge lamp of claim 10, wherein the discharge vessel is made of quartz or an oxidic ceramic material.

13. The high-pressure discharge lamp of claim 10, wherein the discharge vessel is made of densely sintered aluminum oxide.

14. The high-pressure discharge lamp of claim 10, further comprising electrodes made of at least one of tungsten electrodes, rhenium electrodes, and coated electrodes formed by a tungsten core and a coating comprising at least 90% by weight of rhenium.

* * * * *